US005802983A

United States Patent [19]

Manzini

[11] Patent Number: 5,802,983

[45] Date of Patent: Sep. 8, 1998

[54] RAILROAD PLATFORM CART

[75] Inventor: Christopher J. Manzini, Williamsport, Md.

[73] Assignee: Amtrac Railroad Contractors of Maryland, Inc., Hagerstown, Md.

[21] Appl. No.: 803,246

[22] Filed: Feb. 20, 1997

[51] Int. Cl.[6] ..... B61D 3/00; B61D 49/00

[52] U.S. Cl. ..... 105/355; 104/279

[58] Field of Search ..... 104/7.3, 2, 279; 105/4.1, 3, 350, 355, 404, 425, 458, 463.1, 413; 37/235, 236, 104

[56] References Cited

U.S. PATENT DOCUMENTS

| | | | |
|---|---|---|---|
| 1,581,745 | 4/1926 | Kellett . | |
| 2,029,923 | 2/1936 | Herbert | 104/279 |
| 2,584,675 | 2/1952 | Dangerfield | 104/279 |
| 2,906,212 | 9/1959 | Hayes | 104/137 |
| 3,051,098 | 8/1962 | Gutridge | 105/368 |
| 3,719,155 | 3/1973 | O'Leary | 105/367 |
| 3,800,447 | 4/1974 | Harvey | 37/236 |
| 4,179,997 | 12/1979 | Kirwan | 410/53 |
| 4,616,373 | 10/1986 | Perez | 14/72.5 |
| 4,636,130 | 1/1987 | Lenertz et al. | 414/500 |
| 4,780,033 | 10/1988 | Walda et al. | 410/1 |
| 4,829,907 | 5/1989 | Theurer et al. | 104/5 |
| 4,878,435 | 11/1989 | Theurer | 104/9 |
| 4,938,643 | 7/1990 | Lamb et al. | 410/1 |
| 4,958,977 | 9/1990 | Snead | 414/339 |
| 5,249,532 | 10/1993 | Perrot | 105/355 |
| 5,307,744 | 5/1994 | Newman et al. | 105/355 |
| 5,437,232 | 8/1995 | Borowski | 104/279 |
| 5,546,870 | 8/1996 | Meacham et al. | 105/355 |

*Primary Examiner*—Mark Tuan Le

*Attorney, Agent, or Firm*—Finnegan, Henderson, Farabow, Garrett & Dunner, L.L.P.

[57] ABSTRACT

The present invention include a non-motorized low-profile platform cart system for transporting heavy equipment, machinery and vehicles to limited access areas. The system includes a low profile platform cart without motorization and a portable loading ramp for loading vehicles and such onto the cart. The cart may be moved by any motor power source with hi-rail capability other than train engines. The cart also has a rear plow which is capable of removing ballast and debris from the tracks. Use of the cart and ramp allow easy access to limited access areas such as construction areas and bridge repair areas, as well as limited access railway areas where there are no access roads. This invention produces a simple, highly economical solution to the problem of limited access.

12 Claims, 6 Drawing Sheets

RAILROAD PLATFORM CART

BACKGROUND OF THE INVENTION

1. Field of the Invention

The present invention relates to railroad platform carts. More particularly, the present invention relates to a platform cart for transporting materials to work sites. While the invention is subject to a wide range of applications, it is especially suited for use in moving heavy equipment, vehicles and ballast to limited-access rail areas such as repair sites, construction areas and bridges along railways; and will be particularly described in that connection.

2. Description of the Related Art

In the railway industry, transporting machinery, supplies, and crews to limited access track has been extremely difficult. Historically, there have been two methods for handling ballast in order to bring it to limited-access railbeds. Firstly, by rail car and work train, and secondly, by stockpiling at the nearest road location and reloading onto specialized hy-rail trucks or transporting with a front-end loader. The first option requires a great deal of coordination and quite often results in major delays due to availability of cars and work trains, and even under optimum conditions, can only be cost effective when a major number of ballast cars are needed at the same time in approximately the same location. The second option, more commonly used, requires the availability of a stockpiling area, double loading of the material, extra equipment for the second loading and ties up specialized equipment.

In an attempt to meet the demands of the industry and to overcome the above problems, a self-motorized cart (commercially marketed as a "Luttig Lo-Railer") was developed. This particular version of a platform cart allows transport of heavy equipment, supplies and crews to limited access areas. The Lo-Railer is a self-propelled vehicle with a 26'×8½' load space which can travel at speeds up to 15 mph. The motorization of the Lo-Railer requires additional maintenance and adds potential for failure and limits operating speed. The Lo-Railer requires a high initial capital investment which is prohibitive to most small contractors and companies. In addition, there is no flexibility for alternate uses of either the motor power of the Lo-Railer or of the platform cart itself.

Other prior art platform carts use portable loading ramps and suggest transporting heavy equipment via railway. In one instance, a runway forming and Load Receiving Multiple Car Assembly is used which is limited in its capabilities. The cars dump only from the bottom doors and the assembly is designed to move dirt, ballast, and debris which has been loaded into the cars to a designated dump site. The size and weight of the assembly require that a train locomotive be used for motive power and prevents easy relocation of the cart from one work site to another. There is no provision on the assembly for removing from the track any excess ballast which may occur.

In light of the foregoing, there is a need for a simple, versatile, relatively lightweight and cost effective platform cart system which allows easy access to limited access areas.

SUMMARY OF THE INVENTION

Accordingly, the present invention is directed to a platform cart system that substantially obviates the problems due to limitations and disadvantages of the related art. The principle advantage of the present invention is the provision of a relatively lightweight platform cart which can be used in conjunction with any number of motor power sources commonly available at a railway.

The platform cart is designed to travel along the rails of track, motor power being provided by any vehicle which has hi-rail capability and tractive effort. Used in conjunction with a loading ramp, the platform cart provides improved access to limited access areas through transport of heavy equipment, vehicles and machinery to limited access areas.

Additional features and advantages of the invention will be set forth in the description which follows, and in part will be apparent from the description, or may be learned by practice of the invention. The objectives and other advantages of the invention will be realized and attained by the apparatus and system particularly pointed out in the written description and claims hereof as well as the appended drawings.

To achieve these and other advantages and in accordance with the purpose of the invention, as embodied and broadly described, the invention includes a non-motorized low-profile platform cart for transportation of heavy equipment and vehicles to limited access areas comprising a platform cart having a rectangular cart body with an upper surface, an underside, two sides and two ends; the cart having mechanical means formed on one end of the cart body for allowing directional movement of ballast/debris which may be encountered on railroad tracks during operation of the cart, rail wheels connected to the underside of the cart body, means for connecting to a motor power source and air brakes; wherein the cart is capable of attaining speeds of 40 mph, where track conditions permit, when connected to a motor power source capable of the same.

In another aspect, the invention includes a non-motorized low-profile platform cart system for transportation of heavy equipment and vehicles to limited access areas comprising a platform cart having a rectangular cart body with an upper surface, an underside, two sides and two ends; the cart having mechanical means formed on one end of the cart body for allowing directional movement of ballast/debris which may be encountered on railroad tracks during operation of the cart, rail wheels connected to the underside of the cart body, means for connecting to a motor power source and air brakes; and a portable loading ramp for facilitating loading and unloading of the cart, wherein the ramp has a high end and a low end, the high end fitting flush against an end of the cart such that the upper surface of the cart is level with the high end of the ramp when the ramp and cart are placed end to end, wherein the cart is capable of attaining speeds of 40 mph, where track conditions permit, when connected to a motor power source capable of the same.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE PREFERRED EMBODIMENTS

Figure 1A:
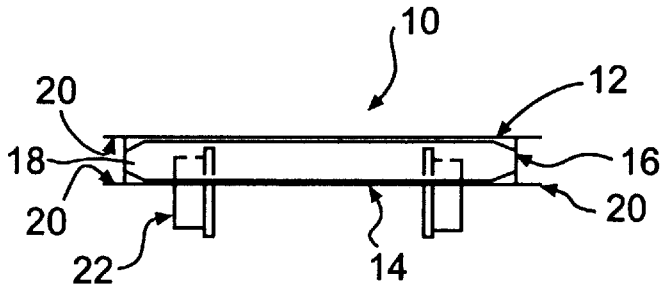
FIG. 1A is a side view of the platform cart of the present invention.

This invention relates to a non-motorized, low-profile platform cart system for the transportation of heavy equipment and vehicles to limited access areas along railways. The system proposed herein is uncomplicated and, as such, cost effective and highly reliable.

In accordance with the present invention, a non-motorized low profile platform cart is provided. The cart is generally rectangular in shape and is equipped with a plow, air brakes, connection means for connecting to a motor power source, and rail wheels for movement along the tracks. This cart may be used in conjunction with a portable ramp which provides access to the cart for loading and unloading.

The non-motorized, low-profile platform cart system includes a platform cart 10. As embodied herein, the platform cart 10 has generally a rectangular body with sides 16,17, ends 18,19, a top surface 12 and an underside 14. The cart is approximately 24 feet long and 9 feet wide, providing an open floor area, the floor being made of ⅜ inch thick diamond plate. The floor may be made from other materials which are capable of supporting the expected loads. The maximum load capacity is two hundred thousand pounds (200,000 lbs.). The platform cart top surface 12 has a height of 18 and ¾ inches above the top of the rail 26. As should be clear to one of ordinary skill in the art, the cart dimensions may vary without departing from the scope of the invention.

The underside of the cart includes a series of supports which provide the supporting structure for top surface 12 of the cart. The supports may be of any appropriate design and material which will provide adequate support for the loads to be transported on the cart. As embodied herein and shown in FIG. 2, it can be seen that the underside 14 of the cart 10 has 8"×8"×½" H-beams which form first supports 32 across the width of the cart and along each end of the cart. There are also 5" channel center floor supports 34 extending across the width of the cart at 4 foot intervals along the length of the cart. Further supporting the cart are support bars 36, which form a diamond-type shape around each center floor support 34. These support bars 36 are made from a 7" channel with ½"×3" flat bar on top. Finally, attached to the underside 14 of the cart are rail wheels 22 which may be of any suitable well known type. The axle 35 connecting each set of rail wheels 22 is supported by two lengthwise supports 40, formed by 8"×8"×½" H-beams and located parallel with, on either side of and equi-distant from a longitudinal axis of the cart. The axle 35 connecting the railwheels 22 lies perpendicular to the H-beam supports.

Figure 2:
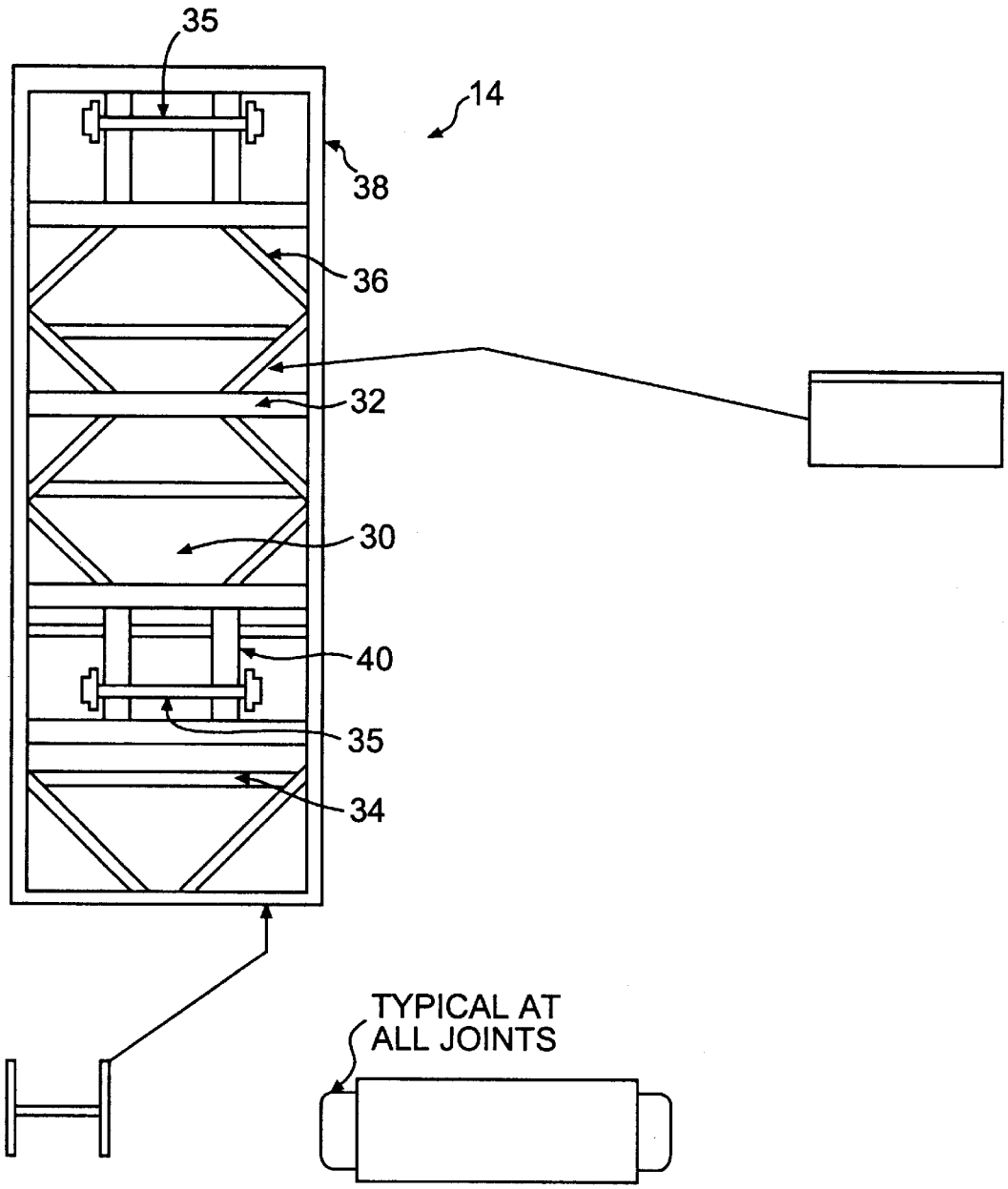
FIG. 2 is a view of the underside of the platform cart.

As embodied herein and shown in FIG. 1A, the sides 16, 17 of the cart may have "wings" 20 for which act to level the ballast after it has been dumped. Wings 20 may work in conjunction with a rear plow 24 by smoothing or leveling out irregularities in the ballast and in any ballast cleared from the tracks by plow 24.The wings 20 may be formed from 6½"×8"×½" H-beams which run along either side of the cart as seen in FIG. 2, or from any other materials which will give the desired shape to wings 20.

Figure 1B:
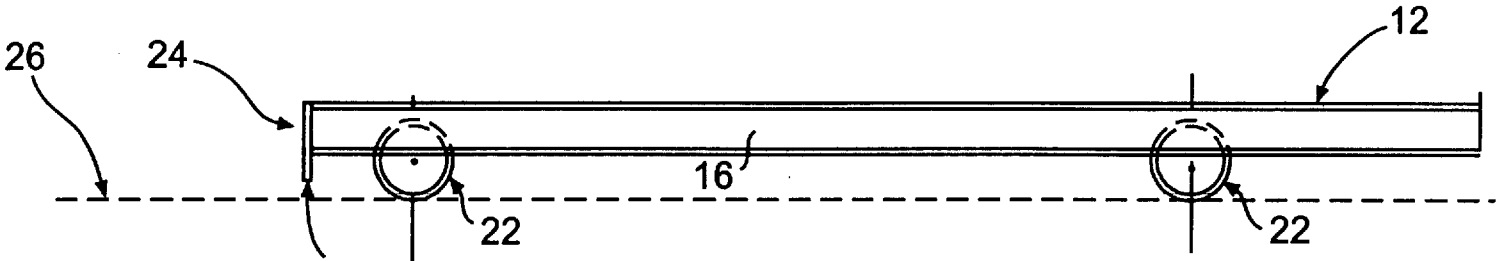
FIG. 1 B is a front view of the platform cart of the present invention.

Cart 10 may also include mechanical means for allowing directional movement of ballast/debris which may be encountered on the railroad tracks during operation of the cart. As embodied herein and shown in FIG. 1B, the mechanical means may take the form of a plow 24 attached to the rear end of cart 10. Plow 24 may extend directly downward from the cart surface such that it is perpendicular to the rear of the cart body. The rear plow 24 ends in a plow base 28 at a point 3" above the top of the rails 26. Rear plow 24 is air controlled and in one embodiment may be activated by a lever thrown manually on the rear side of the platform cart 10. In an alternative embodiment, rear plow 24 may be hydraulically controlled. Optionally, the motor power vehicle used with the cart can be equipped with a standard modification to allow, for example, activation of the plow by the operator of the vehicle from the driver's location.

The cart also has air brakes, which may be connected to an air brake system of the motor power vehicle used to pull the cart. The cart may be towed by use of a pinnel hitch. The platform cart's motive power can be provided by any equipment of the user's choice which has Hi-rail or rail capability and tractive effort. The only modification required to the motor power vehicle is standard and minor in scope to allow coupling of the air brakes to the air brakes on the platform cart when it is directly in tow utilizing a pinnel hitch. Versatility of motor power has two main operating advantages over a selfpowered cart: (1) There is minimal mechanical maintenance of the platform cart required, and therefore, little potential for mechanical failure; and (2) interchangeable motive power allows the option of utilizing a wide range of vehicles based on particular job requirements and/or availability, such that no specialized equipment need be specified. Independent motor power allows operating speed of the platform cart to be dictated by the job conditions and limited only by the speed the independent motor power source is capable of and track conditions. The platform cart, when used with sufficient motor power, is capable of attaining operating speeds of thirty to forty miles per hour where track conditions permit. Desirable motor power sources include any vehicle having hi-rail capability, with the exception of train engines. Hi-rail capability refers to rail wheels, usually retractable, placed on vehicles which allow the vehicles to move on rail tracks as well as highways.

The size and overall weight of the cart allows it to be transported on the bed of most tag-along trailers without special tags or permits. Optionally, the cart may be transported on the bed of the Prentice Self-Loader vehicle. It is possible to extend the length of the platform cart 10, in order to permit transportation of larger vehicles such as tractor trailers or trailers alone.

Figure 3A:
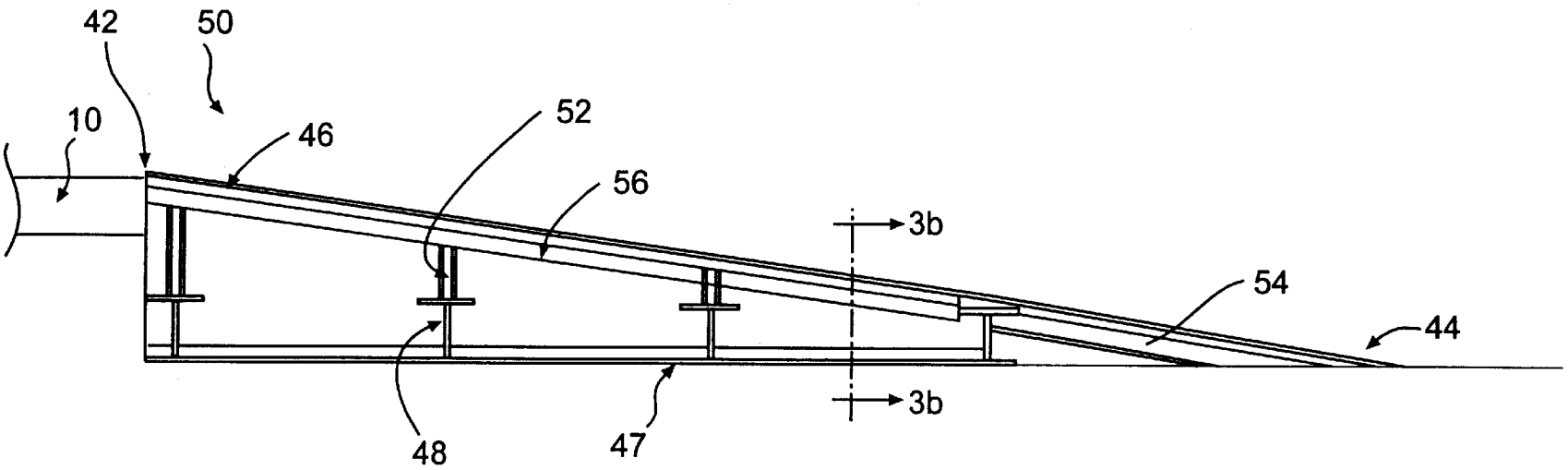
FIG. 3A is a side view of the loading ramp of the present invention.
Figure 3B:
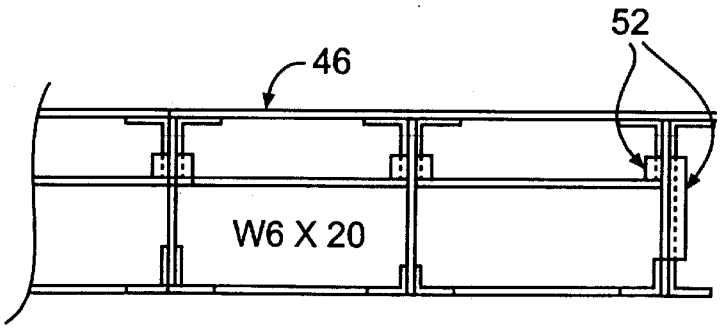
FIG. 3B is a sectional view taken along line A—A of FIG. 3A.
Figure 4:
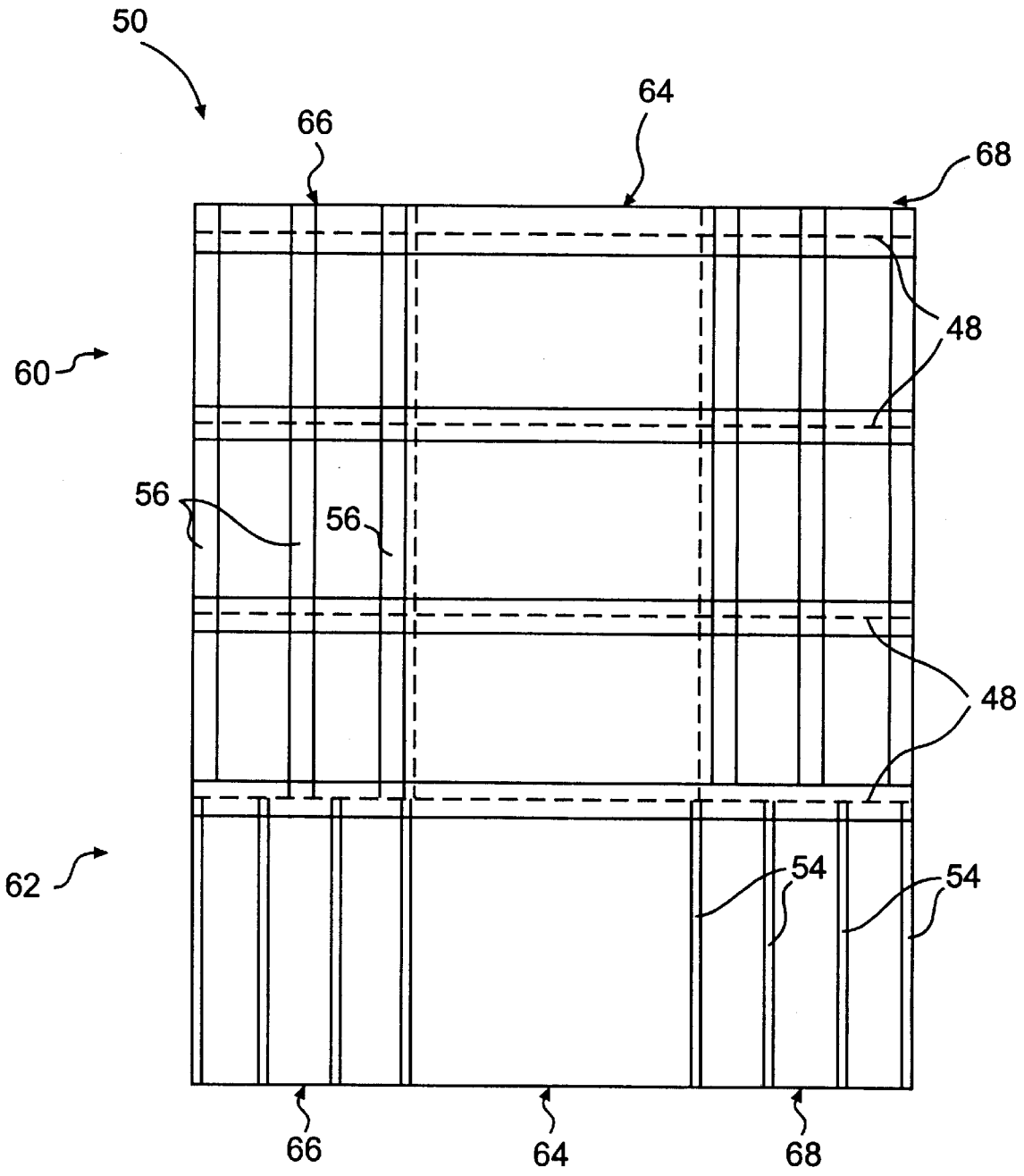
FIG. 4 is a view of the underside of the loading ramp.

In accordance with the present invention, the non-motorized, low-profile platform cart system includes a portable loading ramp 50. As embodied herein, and shown in FIGS. 3A, 3B and 5, portable loading ramp 50 is a free-standing ramp which facilitates loading and unloading of the platform cart 10. As seen in FIG. 3A, the portable loading ramp 50 has a high end 42 and a low end 44, a ramp surface 46 and a ramp base 47. High end 42 of ramp 50 extends 18 and ¾ inches above the top of the rails 26 or "ground level", such that high end 42 of ramp 50 and top surface 12 of cart 10 are level. In the embodiment shown, ramp 50 has a length of approximately 11 feet and a width of approximately 9 feet, with supports extending crosswise for the first 7 feet of length, forming ramp base 47. Ramp surface 46 may be made from ½" diamond plate which extends from high end 42 of ramp 50 to low end 44 of ramp 50, ending at "ground level." Ramp surface 46 does not cover a center area 64 of an upper portion 60 of ramp 50 (see FIG. 4). Ramp surface 46 may also be made from any other suitable material capable of supporting the expected loads. In the embodiment shown, ramp 50 has numerous supports as seen in FIGS. 3A, 3B and 4. Spaced lengthwise along ramp base 47 and extending fully across its width, beginning at high end 42 of ramp 50 and ending at the 7-foot mark, are four cross supports 48, formed in this instance by W6×20×9' supports, although any other support of suitable strength and rigidity may be used. At high end 42 of ramp 50, and at each succeeding cross support 20 48, except for the final cross support, typical channel stiffeners 52 of decreasing height are located between cross supports 48 and ramp surface 46 for support and to provide an incline of ramp 50. Located under the diamond plate and supported by the channel stiffeners are frame supports 56, each comprising a support member of suitable strength and rigidity such as a typical 2×2×¼" angle, which extend from high end 42 of ramp 50 to the final cross support 48. Under the diamond plate, extending from the final cross support 48 to the ground is a ramp support 54 comprising a 3" channel on edge.

As embodied herein and as shown in FIG. 4, ramp 50 has an upper ramp portion 60 and a lower ramp portion 62. Both upper ramp portion 60 and lower ramp portion 62 have a center area 64 and two side portions 66, 68. Center area 64 has a width of 5 feet, and each side portion 66, 68 extends outward 2 feet from an edge of center area 64. In upper ramp portion 60, center area 64 is not covered by the diamond plate floor, but sides 66, 68 do have the diamond plate floor. Upper ramp portion 60 has cross supports 48 as described above as well as frame supports 56 (see also FIG. 3A) which support the diamond plate on the sides 66 and 68. Frame supports 56 are located 3 on each side portion 66, 68, away from center area 64 of ramp 50. There are eight ramp supports 54, each consisting of a 3" channel and supporting lower ramp portion 62, four on each side portion 66, 68 of ramp 50 and away from center area 64 of the ramp. The support mechanisms for ramp 50 as described above are intended to be exemplary only, and it should be obvious that the form and materials of the supports for ramp 50 may be varied by using other materials and designs which provide suitable strength and rigidity without departing from the scope of the invention.

Figure 6:
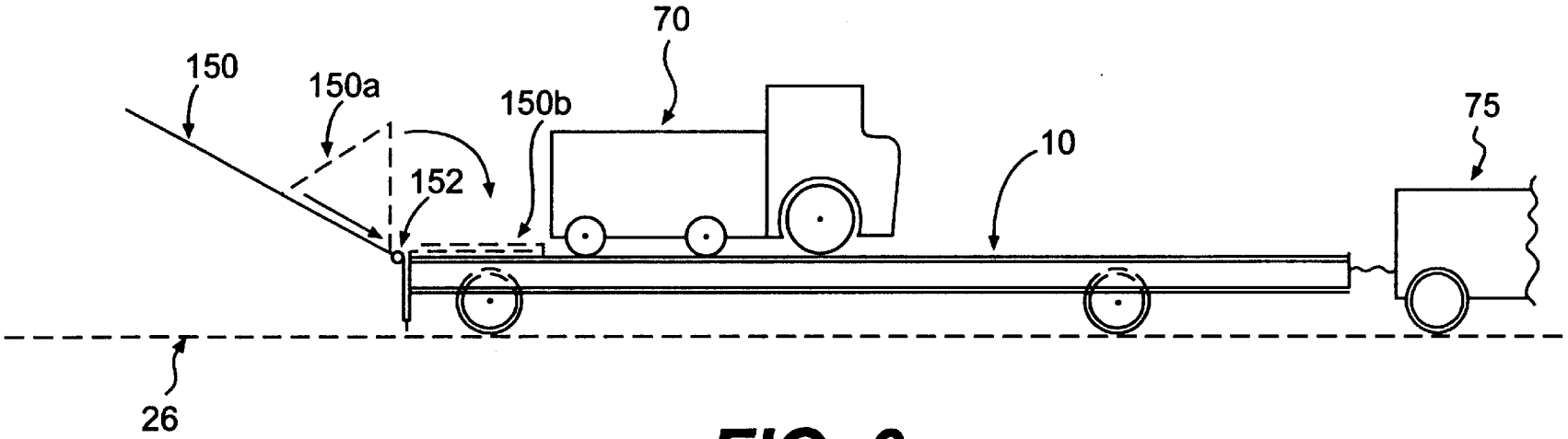
FIG. 6 is a side view of an alternative embodiment of the cart and ramp in use.

In an alternative embodiment, as seen in FIG. 6, ramp 150 may be self-contained or attached to cart 10 by brackets attached to the underside of the cart to allow ramp 150 to slide up "into" cart 10 or attached by hinges 152 so that it may fold up (150*a*, 150*b*) onto cart 10 in order to allow ramp 150 to be transported with cart 10 to a work site. In such an embodiment, ramp 150 could be moveable manually or hydraulically.

Figure 5:
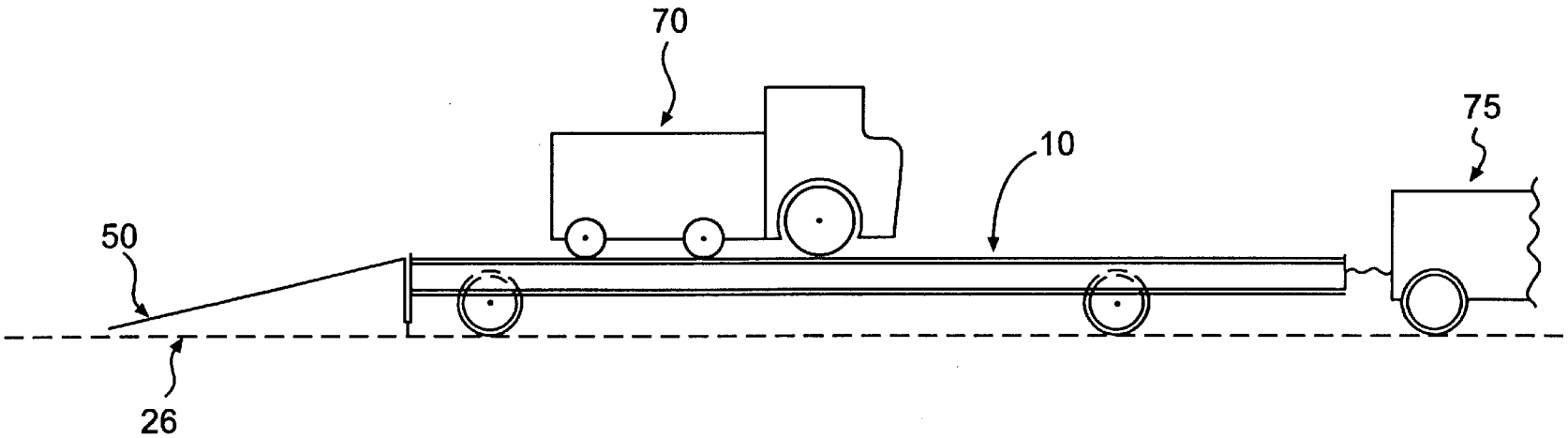
FIG. 5 is a side view of the cart and ramp in use.

In operation, as seen in FIG. 5, platform cart 10 is located on the rails 26 of the track and portable loading ramp 50 is positioned over rails 26 at a location accessible to an on-road vehicle. Platform cart 10 is backed up until it is flush with high end 42 of loading ramp 50, thus allowing loaded or unloaded rubber tired commercial vehicles or trucks, tandem dumps, or triaxle trucks 70 to drive onto platform cart 10. Platform cart 10 is connected to a motor power source 75 such as a HyRail or any other vehicle having rail capability other than train engines. Loading ramp 50 remains in position while the loaded platform cart is then transported to a designated off-load location where needed, the cargo is removed from the cart at the off-load location the same as if it were on normal grade, and platform cart 10 is transported in reverse back to the loading ramp where the process may be repeated as necessary.

It is possible that there may be a second portable loading ramp at the unload location, or if a second ramp is not available and a ramp is needed for unloading, the portable loading ramp may be loaded onto the cart and thus transported to the off-load location.

It will be apparent to those skilled in the art that various modifications and variations can be made in the platform cart and loading ramp of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A non-motorized low-profile platform cart system for transportation of heavy equipment and vehicles to limited access areas comprising:

a platform cart having a rectangular cart body with an upper surface, an underside, two sides and two ends; said cart having mechanical means formed on one end of the cart body for allowing directional movement of ballast/debris which may be encountered on railroad tracks during operation of the cart, rail wheels connected to the underside of the cart body, means for connecting to a motor power source and air brakes; and a portable loading ramp for facilitating loading and unloading of the cart, wherein the ramp has a high end and a low end, the high end fitting flush against an end of the cart such that the upper surface of the cart is level with the high end of the ramp when the ramp and cart are placed end to end, wherein said cart is capable of attaining speeds of 40 mph, where track conditions permit, when connected to a motor power source capable of the same.

2. A non-motorized low-profile platform cart system as in claim 1, wherein said mechanical means is a plow.

3. A non-motorized low-profile platform cart system as defined in claim 2, wherein the plow extends vertically from the surface of the cart to a point 3 inches above the ground.

4. A non-motorized low-profile platform cart system as defined in claim 1, wherein the motor power source is a hi-rail vehicle.

5. A non-motorized low-profile platform cart system as defined in claim 1, wherein said ramp includes connection means for connecting said ramp to said cart, and wherein said connection means allows said ramp to be contained within said cart.

6. A non-motorized low-profile platform cart system as defined in claim 1, wherein the surface of the cart extends levelly 18 and ¾ inches above the ground.

7.A non-motorized low-profile platform cart system as defined in claim 1, wherein said ramp is a free-standing ramp configured to be aligned with said cart.

8. A non-motorized low-profile platform cart system as defined in claim 1, wherein said mechanical means is an air-controlled rear plow.

9. A non-motorized low-profile platform cart system for transportation of heavy equipment and vehicles to limited access areas comprising:

a platform cart having a rectangular cart body with an upper surface, an underside, two sides and two ends;

said cart having an air-controlled rear plow formed on one end of the cart body for allowing directional movement of ballast/debris which may be encountered on railroad tracks during operation of the cart;

said cart having only two axles with rail wheels connected to the underside of the cart body, said cart also having means for connecting to a motor power source and air brakes capable of hooking up to air brakes of the motor power source; and a portable loading ramp for facilitating loading and unloading of the cart, wherein the ramp has a high end and a low end, the high end fitting flush against an end of the cart such that the upper surface of the cart is level with the high end of the ramp when the ramp and cart are placed end to end, wherein said cart is capable of attaining speeds of 40 mph, where track conditions permit, when connected to a motor power source capable of the same.

10. A non-motorized low-profile platform cart system as defined in claim 9, wherein said ramp is a free-standing ramp configured to be aligned with said cart.

11. A non-motorized low-profile platform cart system as defined in claim 9, wherein said ramp is a non-motorized ramp.

12. A non-motorized low-profile platform cart system as defined in claim 9, wherein said ramp includes connection means for connecting said ramp to said cart, and wherein said connection means allows said ramp to be contained within said cart.

* * * * *